US007852286B2

(12) United States Patent
Choi et al.

(10) Patent No.: US 7,852,286 B2
(45) **Date of Patent: *Dec. 14, 2010**

(54) DATA DRIVER AND ORGANIC LIGHT EMITTING DISPLAY DEVICE USING THE SAME

(75) Inventors: Sang Moo Choi, Suwon (KR); Hong Kwon Kim, Euiwang (KR); Oh Kyong Kwon, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1356 days.

This patent is subject to a terminal disclaimer.

(21) Appl. No.: 11/312,227

(22) Filed: Dec. 19, 2005

(65) Prior Publication Data

US 2006/0145965 A1 Jul. 6, 2006

(30) Foreign Application Priority Data

Dec. 24, 2004 (KR) ..... 10-2004-0112521

(51) Int. Cl.
*G09G 3/00* (2006.01)

(52) U.S. Cl. ..... 345/30

(58) Field of Classification Search ..... 345/30, 345/75.2, 76, 77, 82, 98–100, 203–205, 211–213.69, 345/81, 88, 92; 257/59, 72, 359, 208, 210; 315/169.3, 169.1; 341/139, 144, 135, 136
See application file for complete search history.

(56) References Cited

U.S. PATENT DOCUMENTS 5,287,070 A 2/1994 Thelen et al.
5,446,409 A 8/1995 Katakura
6,433,488 B1 * 8/2002 Bu ..... 315/169.3
6,452,448 B1 9/2002 Bonaccio et al.

(Continued)

FOREIGN PATENT DOCUMENTS

JP 2003-186457 7/2003

(Continued)

OTHER PUBLICATIONS

Patent Abstracts of Japan, Publication No. 2003-186457; Publication Date Jul. 4, 2003; in the name of Lee.

(Continued)

*Primary Examiner*—Prabodh M Dharia
(74) *Attorney, Agent, or Firm*—Christie, Parker & Hale, LLP

(57) ABSTRACT

A data driver to display an image with desired brightness, and an organic light emitting display device using the same. The data driver includes a register to temporarily store external data; a voltage digital-analog converter to generate a data voltage corresponding to the data stored in the register part; a current digital-analog converter to generate a data current corresponding to the data stored in the register part; a buffer part to supply the data voltage as a data signal to pixels via a data line; a data control unit to receive a pixel current corresponding to the data voltage from the pixel via the data line and to control a digital value of the data stored in the register part; and a selection unit to selectively couple the data line with either of the buffer part or the data control unit.

20 Claims, 10 Drawing Sheets

U.S. PATENT DOCUMENTS

| | | | | |
|---|---|---|---|---|
| 6,777,885 | B2 * | 8/2004 | Koyama | 315/169.1 |
| 7,042,426 | B2 * | 5/2006 | Shin | 345/76 |
| 7,071,906 | B2 * | 7/2006 | Nishitani et al. | 345/81 |
| 7,109,952 | B2 * | 9/2006 | Kwon | 345/76 |
| 7,109,953 | B2 * | 9/2006 | Abe et al. | 345/76 |
| 7,129,643 | B2 * | 10/2006 | Shin et al. | 315/169.3 |
| 7,180,493 | B2 * | 2/2007 | Shin et al. | 345/92 |
| 7,248,237 | B2 * | 7/2007 | Yamada et al. | 345/76 |
| 7,362,249 | B2 * | 4/2008 | Kim et al. | 341/139 |
| 7,515,121 | B2 * | 4/2009 | Sato et al. | 345/76 |
| 2002/0000828 | A1 | 1/2002 | Krause et al. | |
| 2002/0089357 | A1 | 7/2002 | Pae et al. | |
| 2003/0020413 | A1 * | 1/2003 | Oomura | 315/169.3 |
| 2003/0142048 | A1 * | 7/2003 | Nishitani et al. | 345/82 |
| 2003/0227262 | A1 * | 12/2003 | Kwon | 315/169.3 |
| 2004/0012580 | A1 * | 1/2004 | Yamagishi et al. | 345/204 |
| 2004/0174283 | A1 * | 9/2004 | Sun | 341/136 |
| 2004/0179003 | A1 | 9/2004 | Jang | |
| 2004/0196223 | A1 * | 10/2004 | Kwon | 345/82 |
| 2004/0256617 | A1 * | 12/2004 | Yamada et al. | 257/59 |
| 2005/0052366 | A1 | 3/2005 | Kim | |
| 2005/0121672 | A1 * | 6/2005 | Yamazaki et al. | 257/59 |
| 2005/0200300 | A1 * | 9/2005 | Yumoto | 315/169.1 |
| 2006/0038758 | A1 * | 2/2006 | Routley et al. | 345/81 |
| 2006/0139263 | A1 * | 6/2006 | Choi et al. | 345/76 |
| 2006/0139264 | A1 * | 6/2006 | Choi et al. | 345/76 |
| 2006/0139276 | A1 * | 6/2006 | Choi et al. | 345/92 |
| 2007/0080908 | A1 * | 4/2007 | Nathan et al. | 345/77 |
| 2008/0013349 | A1 | 1/2008 | Yanagida et al. | |
| 2008/0024099 | A1 | 1/2008 | Oki et al. | |

FOREIGN PATENT DOCUMENTS

| | | |
|---|---|---|
| JP | 2004-361888 | 12/2004 |
| JP | 2005-24698 | 1/2005 |

OTHER PUBLICATIONS

Patent Abstracts of Japan, Publication No. 2004-361888; Publication Date Dec. 24, 2004; in the name of Shirasaki.

U.S. Office action dated Apr. 15, 2009, for related U.S. Appl. No. 11/317,792, noting listed U.S. references in this IDS, except 6,433,488 and 2005/0052366.

U.S. Office action dated Oct. 27, 2009, for related U.S. Appl. No. 11/317,792, noting listed U.S. reference 6,433,488 in this IDS.

Patent Abstracts of Japan, Publication No. 2005-024698, dated Jan. 27, 2005, in the name of Katsuhide Uchino et al.

* cited by examiner

DATA DRIVER AND ORGANIC LIGHT EMITTING DISPLAY DEVICE USING THE SAME

CROSS-REFERENCE TO RELATED APPLICATION

This application claims priority to and the benefit of Korean Patent Application No. 10-2004-0112521, filed on Dec. 24, 2004, in the Korean Intellectual Property Office, the entire content of which is incorporated herein by reference.

BACKGROUND OF THE INVENTION

1. Field of the Invention

The present invention relates to a data driver, an organic light emitting display device using the same, and more particularly, to a data driver to display an image with desired brightness and an organic light emitting display device using the same.

2. Description of Related Art

Various flat panel displays have recently been developed as alternatives to a relatively heavy and bulky cathode ray tube (CRT) display. The flat panel displays include liquid crystal display (LCD), field emission display (FED), plasma display panel (PDP), organic light emitting display device (OLED), and the like.

Among the flat panel displays, the organic light emitting display device can emit light by electron-hole recombination. The organic light emitting display device has advantages of relatively fast response time and relatively low power consumption. Generally, the organic light emitting display device employs a transistor provided in each pixel for supplying current corresponding to a data signal to a light emitting device, thereby causing the light emitting device to emit light.

FIG. 1 illustrates a conventional organic light emitting display device. The conventional organic light emitting display device includes a display region 30 including pixels 40 formed in a region defined by intersection of scan lines S1 to Sn and data lines D1 to Dm; a scan driver 10 to drive the scan lines S1 to Sn; a data driving part 20 to drive the data lines D1 to Dm; and a timing controller 50 to control the scan driver 10 and the data driving part 20. Each pixel 40 includes a transistor for supplying current to a light emitting device (not shown).

The timing controller 50 generates a data control signal DCS and a scan control signal SCS corresponding to an external synchronization signal. The data control signal DCS and the scan control signal SCS are supplied from the timing controller 50 to the data driving part 20 and the scan driver 10, respectively. Further, the timing controller 50 supplies external data to the data driving part 20.

The scan driver 10 receives the scan control signal SCS from the timing controller 50. The scan driver 10 generates scan signals on the basis of the scan control signal SCS and supplies the scan signals to the scan lines S1 to Sn.

The data driving part 20 receives the data control signal DCS from the timing controller 50. The data driving part 20 generates data signals on the basis of the data control signal DCS and supplies the data signals to the data lines D1 to Dm while synchronizing with the scan signals.

The display region 30 receives first voltage ELVDD and second voltage ELVSS from a power source, and supplies them to the pixels 40. When the first voltage ELVDD and the second voltage ELVSS are applied to the pixels 40, each pixel 40 controls and causes a current corresponding to the data signal to flow from a first voltage ELVDD power source line to a second voltage ELVSS power source line via the light emitting device, thereby emitting light corresponding to the data signal.

That is, in the conventional organic light emitting display device, each pixel 40 emits light with a predetermined brightness corresponding to the data signal, but cannot emit light with desired brightness because transistors provided in the respective pixels 40 are different in threshold voltage from each other. Further, in the conventional organic light emitting display device, there is no method of measuring and controlling the real current in each pixel 40 corresponding to the data signal.

SUMMARY OF THE INVENTION

Accordingly, the present invention provides a data driver for displaying an image with desired brightness, an organic light emitting display device using this data driver, and a method of driving the organic light emitting display device.

In one embodiment of the invention, the organic light emitting display device uses a data driver, which compares a data current corresponding to data with a pixel current in a pixel, and controls a digital value of the data on the basis of the outcome of the comparison so as to approximately equalize the pixel current with the data current, thereby displaying an image with desired brightness. Particularly, according to an embodiment of the present invention, the pixel current is supplied from the pixel to the data driver via a data line, and a data voltage is supplied from the data driver to the pixel via the data line. That is, according to embodiments of the present invention, the data line is shared to also drive the pixel, so that additional lines are not needed, thereby enhancing aperture ratio and simplifying the fabricating process.

The foregoing and other aspects of the present invention are achieved by providing a data driving part including: a register part to temporarily store external data; a voltage digital to analog or digital-analog converter to generate a data voltage corresponding to the data stored in the register part; a current digital to analog converter to generate a data current corresponding to the data stored in the register part; a buffer part to supply the data voltage as a data signal to pixels via a data line; a data control unit to receive a pixel current corresponding to the data voltage from the pixel via the data line and to control a digital value of the data stored in the register part; and a selection unit to selectively couple the data line with either of the buffer part or the data control unit.

According to an aspect of the invention, the selection unit couples the data line with the buffer part for a first period of one horizontal period, and alternately couples the data line with either of the buffer part or the data control unit for a second period of one horizontal period except the first period. Further, the selection unit includes selectors, each selector including: a first transistor coupled between the buffer part and the data line; and a second transistor coupled between the data line and the data control unit. The first transistor is turned on for the first period, and the first transistor is tuned on and off alternately with the second transistor for the second period. Also, the data voltage is supplied to the pixel via the data line when the first transistor is turned on, and the pixel current is supplied from the pixel to the data control unit via the data line when the second transistor is turned on.

Other aspects of the present invention are achieved by providing an organic light emitting display device including first and second scan lines, data lines formed in a direction intersecting the direction of the first and second scan lines, a display region including pixels coupled to the first and second scan lines and the data line, a scan driver to sequentially supply first and second scan signals to the first and second scan lines, respectively, and a data driving part coupled to the data line, converting external data into a data voltage, and supplying the data voltage to the data line, wherein the data driving part receives a pixel current that flows in each pixel corresponding to the data voltage from each pixel via the data line, and controlling a digital value of the data in accordance with the received pixel current.

According to an aspect of the invention, each pixel includes a light emitting device, a driver to generate the pixel current corresponding to the data voltage, a first transistor coupled between the driver and the data line, and controlled by a first scan signal supplied through the first scan line, and a second transistor coupled between the data line and a common node formed between the driver and the light emitting device, and controlled by a second scan signal supplied through the second scan line. Further, the first transistor is turned on corresponding to the first scan signal for a first period of a predetermined horizontal period, and turned on and off at least once for a second period of the horizontal period. Also, the second transistor is turned off corresponding to the second scan signal for the first period, and turned on and off alternately with the first transistor for the second period.

Another aspect of the invention provides a method for controlling image brightness corresponding to data received in an organic light emitting display device having a pixel for emitting light. The method includes converting the data into a data voltage and a data current, supplying the data voltage to the pixel to generate a pixel current corresponding to the data voltage, comparing the pixel current with the data current, and controlling the data voltage to provide a desired image brightness by incrementing the data voltage if the pixel current is lower than the data current and decrementing the data voltage if the pixel current is higher than the data current.

In another embodiment, the method may also include allowing the data current to flow into the pixel by supplying a first scan signal to the pixel, and allowing a pixel current generated in the pixel to flow out of the pixel by supplying a second scan signal to the pixel. The first scan signal and the second scan signal are supplied non-concurrently. A control signal may be received for selecting either supplying the data voltage to the pixel or receiving the pixel current from the pixel. The pixel may be driven during frames and each frame may be divided into a first period and a second period separate from the first period. The control signal for supplying the data voltage to the pixel may be received during the entire first period, and the control signal for the supplying the data voltage to the pixel and the control signal for the receiving the pixel current from the pixel may be received alternately during the second period. The data may be converted into the data current while supplying the data voltage to the pixel but not while receiving a pixel current from the pixel.

DETAILED DESCRIPTION

Figure 1:
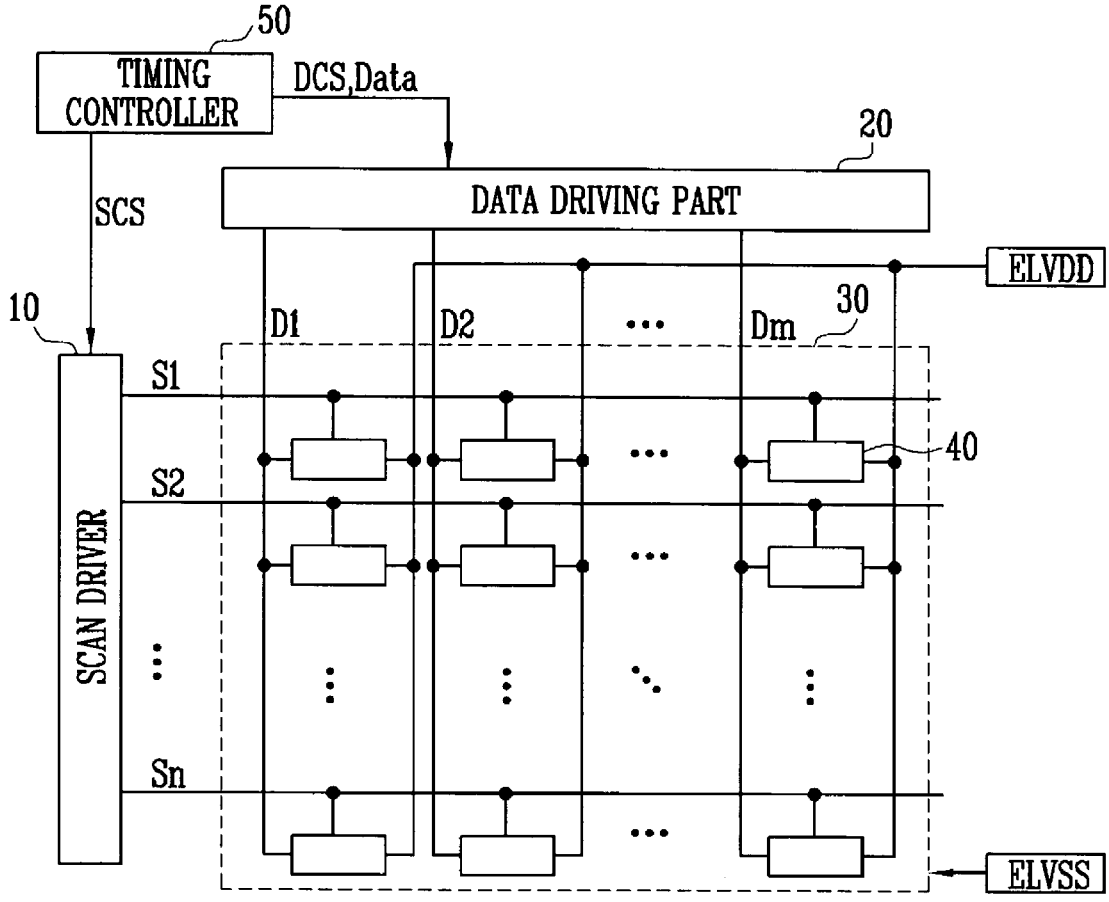
FIG. 1 (PRIOR ART)
FIG. 1 is a layout diagram showing a conventional organic light emitting display device.
Figure 2:
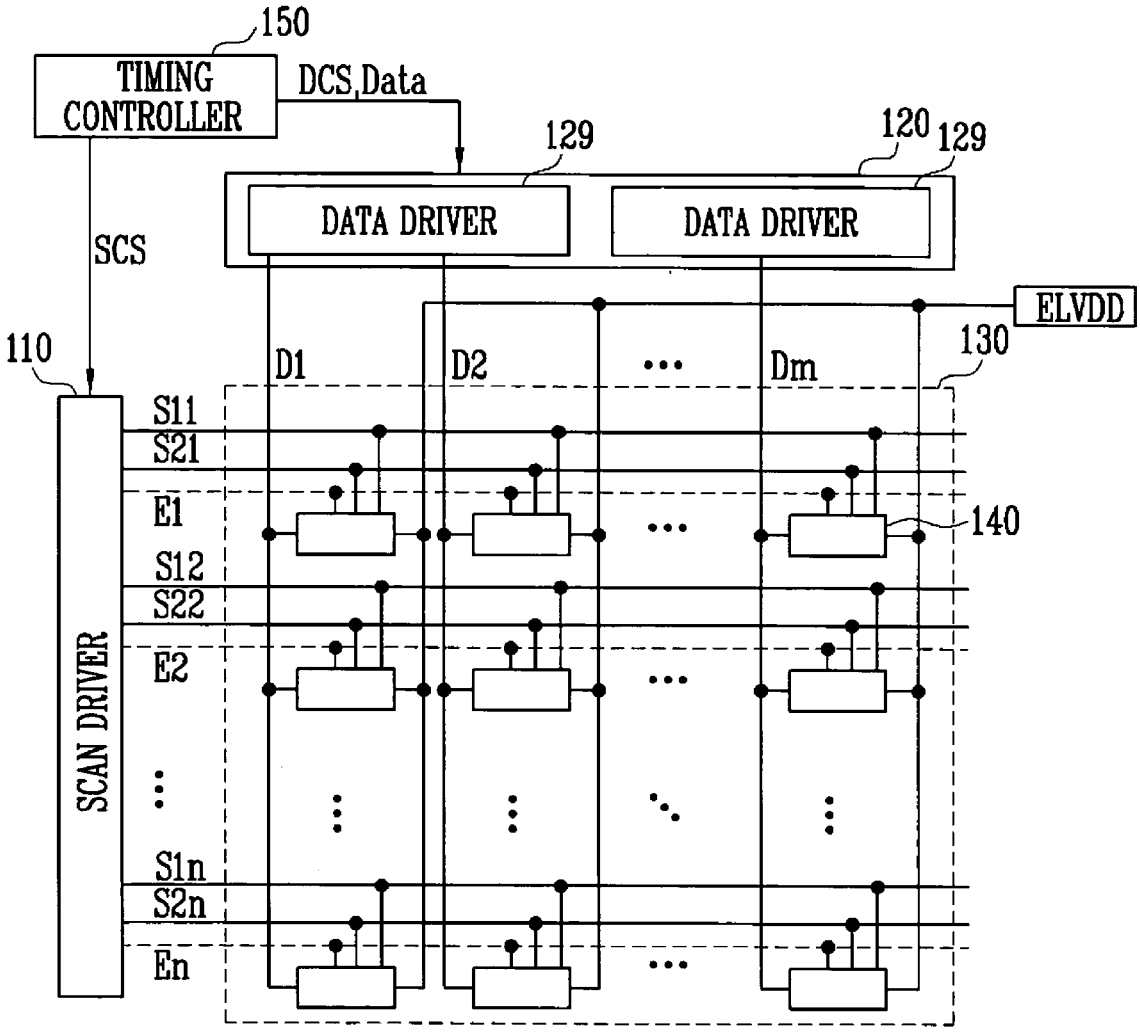
FIG. 2 is a layout diagram showing an organic light emitting display device according to an embodiment of the present invention.

FIG. 2 illustrates an organic light emitting display device according to an embodiment of the present invention. This organic light emitting display device includes a display region 130 having pixels 140 formed in regions defined by first scan lines S11 to S1*n*, second scan lines S21 to S2*n*, emission control lines E1 to En, and data lines D1 to Dm; a scan driver 110 to drive the first scan lines S11 to S1*n*, the second scan lines S21 to S2*n*, and the emission control lines E1 to En; a data driving part 120 to drive the data lines D1 to Dm; and a timing controller 150 to control the scan driver 110 and the data driving part 120.

The display region 130 includes the pixels 140 formed in regions defined by the first scan lines S11 to S1*n*, the second scan lines S21 to S2*n*, the emission control lines E1 to En and the data lines D1 to Dm. The pixels 140 receive external first voltage ELVDD. In alternative embodiments, an external second voltage ELVSS (not shown) may also be coupled to the pixels 140. When the first voltage ELVDD and the second voltage ELVSS are applied to the pixels 140, each pixel 140 controls a pixel current causing it to flow from a first voltage ELVDD source line to a second voltage ELVSS source line via a light emitting device corresponding to a data signal transmitted through the corresponding one of the data lines D1 to Dm. Further, the pixel 140 supplies the pixel current to the data driving part 120 via the corresponding one of the data lines D1 to Dm for a partial horizontal period.

The timing controller 150 generates a data control signal DCS and a scan control signal SCS in response to external synchronization signals. The timing controller 150 supplies the data control signal DCS and the scan control signal SCS to the data driving part 120 and the scan driver 110, respectively. Further, the timing controller 150 supplies external data Data to the data driving part 120.

The scan driver 110 receives the scan control signal SCS from the timing controller 150. In response to the scan control signal SCS, the scan driver 110 sequentially supplies first scan signals to the first scan lines S11 to S1*n*, and at the same time sequentially supplies second scan signals to the second scan lines S21 to S2*n*.

Figure 3:
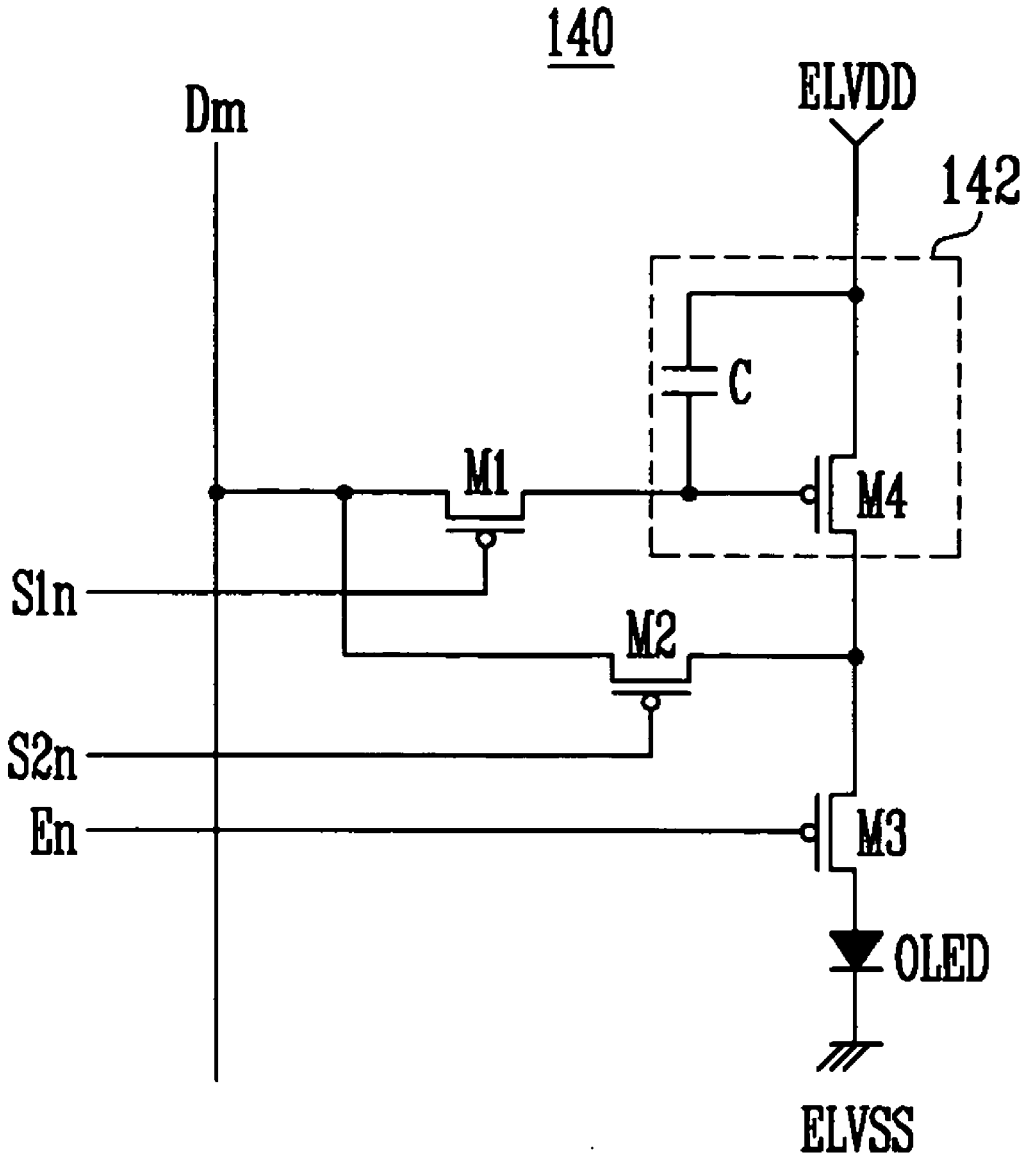
FIG. 3 is a circuit diagram of a pixel illustrated in FIG. 2.
Figure 4:
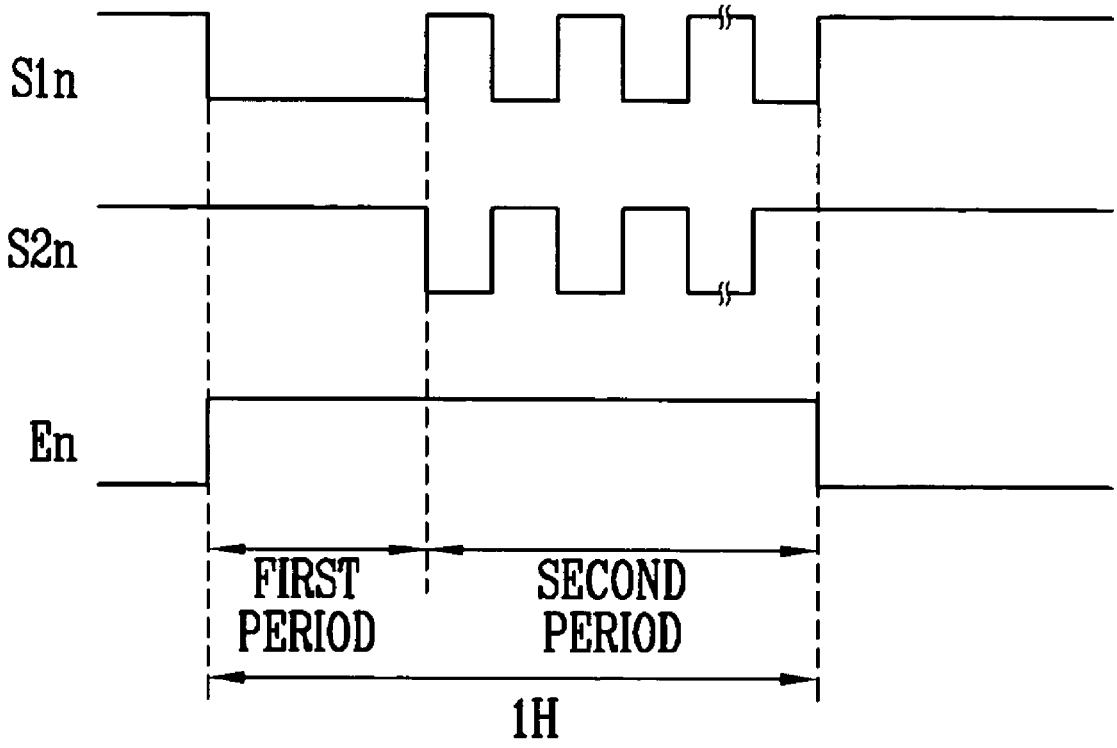
FIG. 4 shows waveforms of signals for driving the pixel illustrated in FIG. 3.

FIG. 3 is a circuit diagram of a pixel illustrated in FIG. 2 and FIG. 4 shows waveforms of signals for driving the pixel illustrated in FIG. 3. These two figures, FIG. 3 and FIG. 4, are discussed together.

As shown in FIG. 4, the scan driver 110 supplies a first scan signal S1*n* to turn on a first transistor M1 provided in the pixel 140, shown in FIG. 3, for a first period of one horizontal period 1H, and to repeatedly turn on and off the first transistor M1 for a second period of the one horizontal period 1H. Further, the scan driver 110 supplies a second scan signal S2*n* to turn off a second transistor M2 provided in the pixel 140 for the first period of the one horizontal period 1H, and to repeatedly turn on and off the second transistor M2 alternately with the first transistor M1. Also, the scan driver 110 supplies an emission control signal En to turn off a third transistor M3 provided in the pixel 140 for a predetermined horizontal period during which the first and second scan signals S1*n*, S2*n* are supplied, and to turn on the third transistor M3 for the other period. According to an embodiment of the present invention, the emission control signal En is supplied overlapping with the first and second scan signals S1*n*, S2*n*, and has a duration or width equal to or larger than that of the first scan signal S1*n*.

Referring back to FIG. 2, the data driving part 120 receives the data control signal DCS from the timing controller 150. Then, the data driving part 120 generates the data signal in response to the data control signal DCS, and supplies the data signal to the data lines D1 to Dm. The data driving part 120 supplies a predetermined data voltage as the data signal to the data lines D1 to Dm.

The data driving part 120 receives a pixel current from the pixel 140 for a partial second period of one horizontal period, and checks whether the received pixel current has a level corresponding to the data Data. For example, when a pixel current in the pixel 140 corresponding to a digital value (or level) of the data Data is 10 μA, the data driving part 120 checks whether the received pixel current is 10 μA. When the data driving part 120 receives an undesired current from each pixel 140, the data driving part 120 controls the data voltage, thereby allowing a desired current to flow in each pixel 140. The data driving part 120 includes at least one data driver 129 having j channels where j is a natural number. Detailed configuration of the data driver 129 will be described later.

FIG. 3 is a circuit diagram of a pixel illustrated in FIG. 2. For the sake of convenience, FIG. 3 exemplarily illustrates a pixel that is coupled to the mth data line Dm, the nth first scan line S1*n*, the nth second scan line S2*n*, and the nth emission control line En.

The pixel 140 according to an embodiment of the present invention includes a first transistor M1, a second transistor M2, a third transistor M3 and a driver 142.

The first transistor M1 is coupled between the data line Dm and the driver 142, and supplies the data voltage from the data line Dm to the driver 142. The first transistor M1 is controlled by the first scan signal transmitted through the nth first scan line S1*n*.

The second transistor M2 is coupled between a data line Dm and the driver 142, and supplies the pixel current from the driver 142 to the data line Dm. The second transistor M2 is controlled by the second scan signal transmitted through the nth second scan line S2*n*.

The third transistor M3 is coupled between the driver 142 and a light emitting device OLED. The third transistor M3 is controlled by the emission control signal transmitted through the nth emission control line En. At this time, the emission control signal is supplied overlapping with the first and second scan signals respectively supplied through the nth first and second scan lines S1*n* and S2*n*. The third transistor M3 is turned off while the emission control signal is supplied, and is tuned on while the emission control signal is not supplied.

The driver 142 supplies the pixel current to the second transistor M2 and the third transistor M3 corresponding to the data signal received from the first transistor M1. The driver 142 includes a fourth transistor M4, coupled between a first power source line supplying first voltage ELVDD and the third transistor M3, and a capacitor C coupled between a gate electrode of the fourth transistor M4 and the first power source line supplying first voltage ELVDD. Alternatively, the driver 142 is not limited to the configuration shown in FIG. 3, and may include one of various circuits well-known in the art. Also, the transistors M1 through M4 are illustrated as p-channel metal oxide semiconductor (PMOS) transistors, but not limited to this type.

The operation of the pixel 140 may be explained also by referring to FIGS. 3 and 4. For a predetermined horizontal period 1H of one frame, the first scan signal is supplied through the nth first scan line S1*n*, and at the same time, the second scan signal is supplied through the nth second scan line S2*n*. The first transistor M1 receives the first scan signal and is turned on for the first period of the one horizontal period 1H. As the first transistor M1 is turned on, the data signal of the data line Dm is supplied to the capacitor C for the first period. At this time, the capacitor C is charged to a predetermined voltage corresponding to the data signal received by M1. The second transistor M2 receives the second scan signal and stays turned off for the duration of the first period.

Next, the first transistor M1 is turned off and the second transistor M2 is turned on for a part of the second period. As the second transistor M2 is turned on, the pixel current is supplied from the fourth transistor M4 to the data line Dm corresponding to the predetermined voltage to which the capacitor C was charged. The pixel current is supplied from the data line Dm to the data driving part 120, and the data driving part 120 increments or decrements the level of the data voltage in accordance with the pixel current, thereby allowing a desired pixel current to flow to the pixel 140.

Afterward, the second transistor M2 is turned off, and the first transistor M1 is turned on for a portion of the second period. As the first transistor M1 is turned on, the data voltage, increased or decreased by the data driving part 120, is supplied to the capacitor C, thereby controlling the level of the voltage to which the capacitor C is charged. In essence, the first transistor M1 and the second transistor M2 are alternately turned on and off at least one time for the second period, so that the voltage charged in the capacitor C is controlled to allow the desired pixel current to flow through the pixel 140.

The emission control signal is supplied to the nth emission control line En for the predetermined horizontal period 1H, so that the third transistor M3 is turned off. Therefore, the pixel current is not supplied to the light emitting device OLED. The emission control signal is not supplied to the nth emission control line En after the lapse of the predetermined horizontal period 1H, so that the pixel current is supplied to the light emitting device OLED. Here, the pixel current is adjusted or controlled into a desired current level for the duration of the predetermined horizontal period 1H, so that the light emitting device OLED can emit light with the desired brightness.

Figure 5:
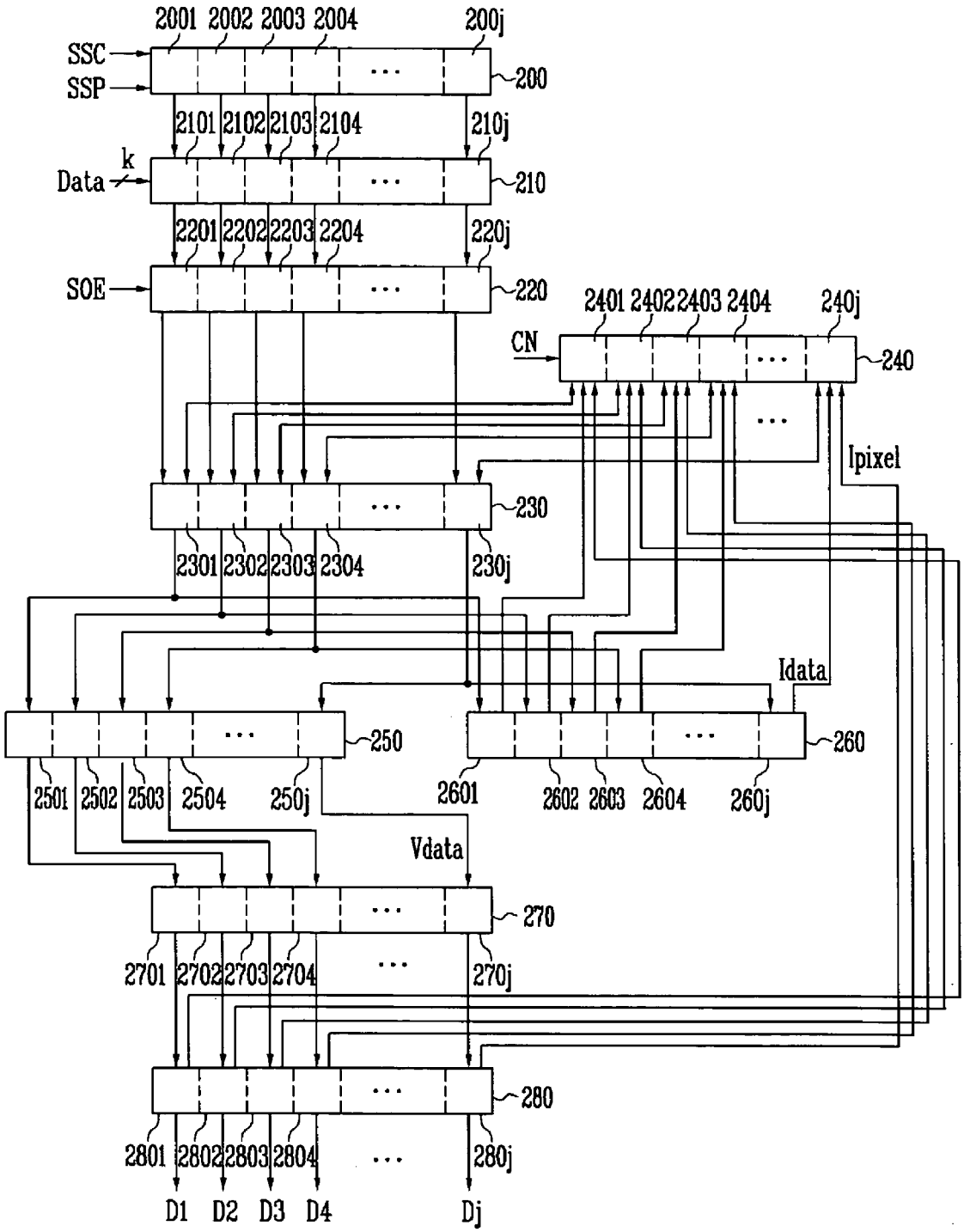
FIG. 5 is a schematic block diagram showing an embodiment of data driver illustrated in FIG. 2.

FIG. 5 is a unit diagram showing an embodiment of a data driver 129 illustrated in FIG. 2. For the sake of convenience, FIG. 5 exemplarily illustrates a pixel Driver having j channels.

The data driver 129 includes a shift register 200 to generate sampling signals in sequence, a sampling latch 210 to store the data Data in sequence in response to the sampling signals, a holding latch 220 to temporarily store the data Data of the sampling latch 210 and supply the stored data Data to a register 230, the register 230 to temporarily store the data Data supplied from the holding latch 220, a data control unit 240 to increment or decrement the digital value of the data Data stored in the register 230, a voltage digital-analog converter (VDAC) 250 to generate the data voltage Vdata corresponding to the digital value of the data Data stored in the register 230, a current digital-analog converter (IDAC) 260 to generate the data current Idata corresponding to the digital value of the data Data stored in the register 230, a buffer 270 to supply the data voltage Vdata from the VDAC 250 to the data lines D1 to Dj, and a selection unit 280 to selectively couple the data lines D1 to Dj with either of the buffer 270 or the data control unit 240. The data current Idata may alternatively be called a sensing current.

The shift register 200 receives a source shift clock SSC and a source start pulse SSP from the timing controller 150 and shifts the source start pulse SSP per period of the source shift clock SSC, thereby generating j sampling signals in sequence. The shift register 200 includes j shift registers 2001 through 200*j*.

The sampling latch 210 stores the data Data in sequence, in response to the sampling signals sequentially supplied from the shift register 200. The sampling latch 210 may include j sampling latches 2101 through 210*j* to store j data Data. Further, the size of each sampling latches 2101 through 210*j* corresponds to a digital value of the data Data. For example, in the case where the data Data is of k bits, each of the sampling latches 2101 through 210*j* has a size corresponding to k bits.

The holding latch 220 receives the data Data from the sampling latch 210 and stores it in response to a source output enable signal SOE. Further, the holding latch 220 supplies the data Data stored in the holding latch 220 to the register 230 in response to the source output enable signal SOE. The holding latch 220 may include j holding latches 2201 through 220*j* each corresponding to k bits.

The register 230 temporarily stores the data Data supplied from the holding latch 220. The data Data stored in the register 230 is supplied to the data control unit 240, the VDAC 250, and the IDAC 260. The register 230 may include j registers 2301 through 230*j* each corresponding to k bits.

The data control unit 240 receives the data current Idata, the pixel current Ipixel, and the data Data. The data control unit 240 compares the data current Idata with the pixel current Ipixel, and controls the digital value of the data Data on the basis of the result of the comparison. Ideally, the data control unit 240 controls the digital value of the data Data to make the data current Idata equal to the pixel current Ipixel. The data Data adjusted or controlled in the data control unit 240 (hereinafter, referred to as "reset data") is supplied to the register 230. The data control unit 240 may include j data controllers 2401 through 240*j*.

The VDAC 250 generates the data voltage Vdata corresponding to the digital value of the data Data or the reset data Data, and supplies the data voltage Vdata to the buffer 270. The VDAC 250 may generate j data voltages Vdata corresponding to j data Data (or j reset data) supplied from the register 230. The VDAC 250 may include j data voltage generators 2501 through 250*j*.

The IDAC 260 generates the data current Idata corresponding to the digital value of the data Data, and supplies the data current Idata to the data control unit 240. The IDAC 260 may generate j data current Idata corresponding to j data Data supplied from the register 230. The VDAC 250 may also include j data current generators 2601 through 260*j*.

The buffer 270 supplies the data voltage Vdata from the VDAC 250 to the selection unit 280. The buffer 270 may include j buffers 2701 through 270*j*. The selection unit 280 selectively couples the data lines D1 to Dj to either the buffer 270 or the data control unit 240. The selection unit 280 may include j selectors 2801 through 280*j*.

Figure 6:
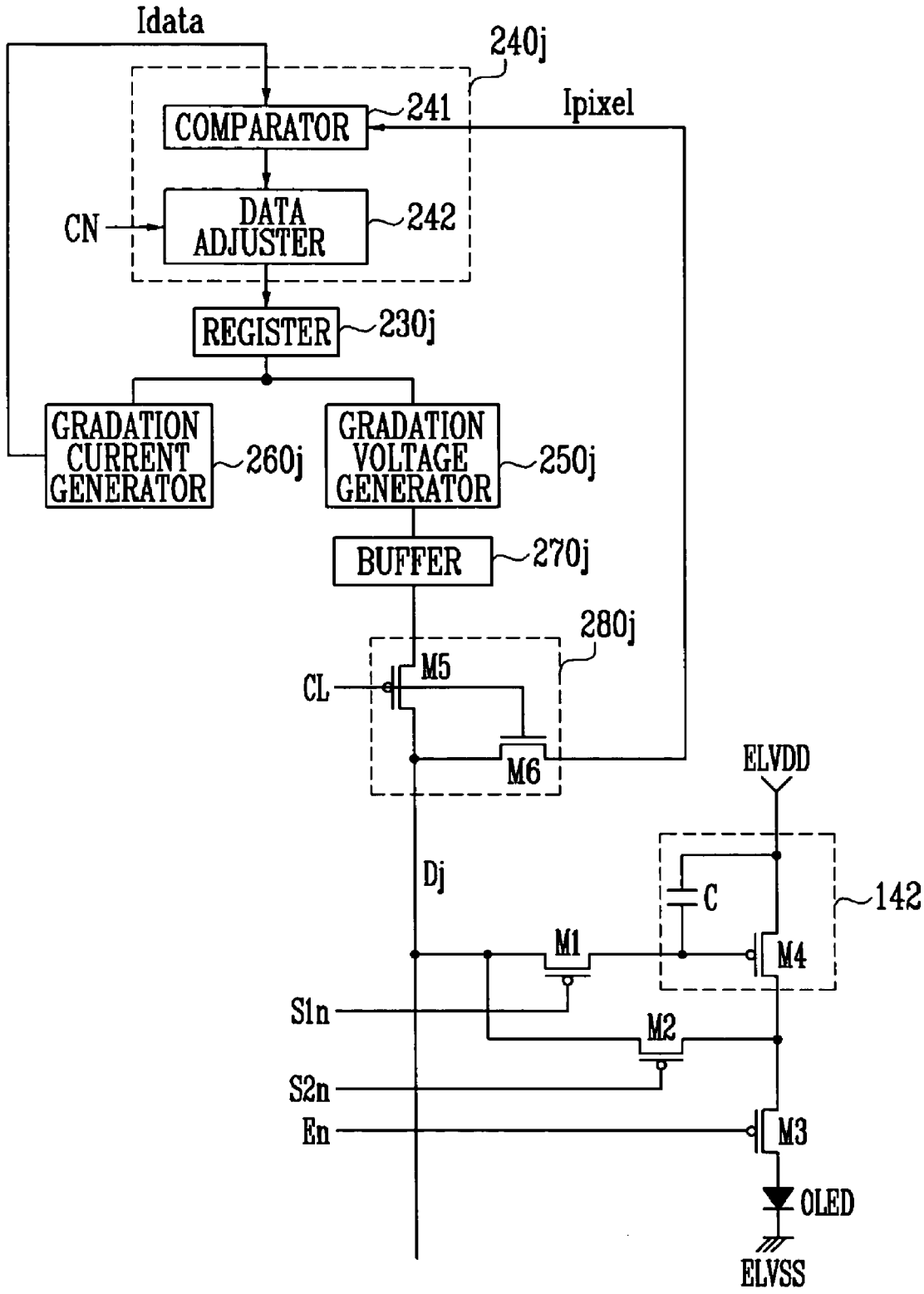
FIG. 6 is a detailed unit diagram of a data controller and a selector provided in the data driver illustrated in FIG. 5.

FIG. 6 is a detailed unit diagram of a data controller and a selector provided in the data driver illustrated in FIG. 5. For the sake of convenience, FIG. 6 exemplarily illustrates the jth data controller 240*j* and the jth selector 280*j*. The selector 280*j* includes a fifth transistor M5 coupled between the buffer 270*j* and the data line Dj, and a sixth transistor M6 coupled between the data controller 240*j* and the data line Dj.

The fifth transistor M5 and the sixth transistor M6 are turned on alternately with each other so that when one is on the other is off. These transistors M5, M6 couple the data line Dj with either the buffer 270*j* or the data controller 240*j*. To achieve this task, the fifth transistor M5 and the sixth transistor M6 are different in conductivity type. For example, if one is an NMOS, the other would be a PMOS. The fifth transistor M5 and the sixth transistor M6 may be controlled by a selection signal supplied through a control line CL.

Figure 7:
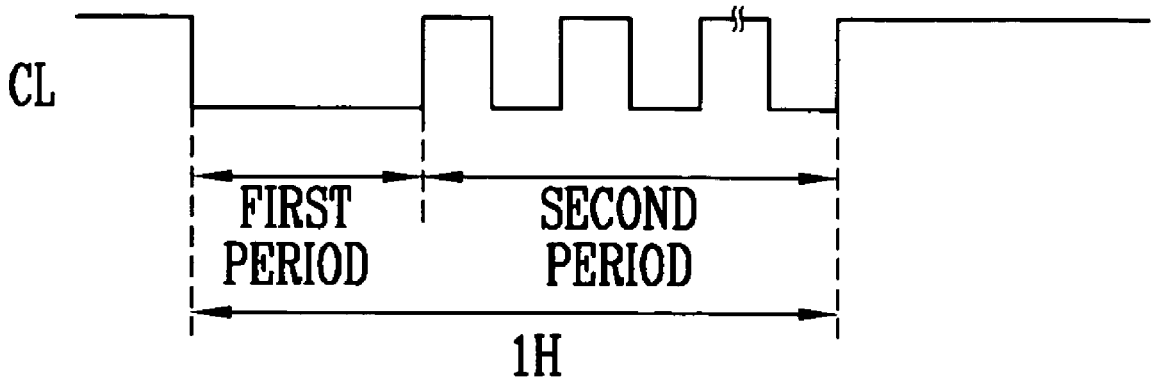
FIG. 7 shows a waveform of a signal for driving the selector illustrated in FIG. 6.

FIG. 7 shows a waveform of a signal for driving the selector illustrated in FIG. 6. The selection signal CL is supplied during the first period of one horizontal period 1H to turn on the fifth transistor M5. Further, the selection signal CL is supplied to turn on and off the fifth and sixth transistors M5 and M6 alternately during the second period. In essence, during the second period, the selection signal CL is supplied to turn on and turn off the fifth transistor M5 in accordance with the first transistor M2, and turn on and turn off the sixth transistor M6 in accordance with the second transistor M2.

Referring back to FIG. 6, the data controller 240*j* includes a comparator 241, and a data adjuster 242. The comparator 241 receives the data current Idata from the data current generator 260*j*, and receives the pixel current Ipixel from the pixel 140 via the selector 280*j*. The pixel current Ipixel may be supplied from the pixel 140 receiving the first and second scan signals. The comparator 241 receives the pixel current Ipixel and the data current Idata, and compares the pixel current Ipixel with the data current Idata. Then, the comparator 241 supplies a first control signal or a second control signal to the data adjuster 242 on the basis of the result of the comparison. For example, when the data current Idata is higher than the pixel current Ipixel, the comparator 241 generates the first control signal. On the other hand, when the data current Idata is lower than the pixel current Ipixel, the comparator 241 generates the second control signal.

The data adjuster 242 receives the data Data from the register 230*j* and stores it. Further the data adjuster 242 receives the first control signal or the second control signal from the comparator 241, and receives a constant value CN from the outside. Then, the data adjuster 242 increments or decrements the digital value of the data Data by the constant value CN, thereby controlling the data Data. The data Data adjusted by the data adjuster 242 is supplied to the register 230*j*.

The data controller 240*j* operates as follows. For the first period of one horizontal period 1H, the register 230*j* supplies the data Data from the holding latch 220*j* to the data adjuster 242, the data voltage generator 250*j*, and the data current generator 260*j*. The data voltage generator 250*j* receives the data Data, and generates the data voltage Vdata corresponding to the digital value of the data Data, thereby supplying the data voltage Vdata to the buffer 270*j*. Then, the data current generator 260*j* receives the data Data, and generates the data current Idata corresponding to the digital value of the data Data, thereby supplying the data current Idata to the comparator 240*j*.

For the first period of one horizontal period 1H, the fifth transistor M5 and the first transistor M1 are tuned on, but the sixth transistor M6 and the second transistor M2 are tuned off. When the fifth transistor M5 and the first transistor M1 are turned on, the data voltage Vdata generated by the data voltage generator 250*j* is supplied to the driver 142 via the buffer 270*j*, the fifth transistor M5, the data line Dj, and the first transistor M1. Then, the capacitor C provided in the driver 142 is charged with a voltage corresponding to the data voltage Vdata. In essence, the first period is set to allow the capacitor C of the pixel 140 to be charged with a predetermined voltage corresponding to the first data voltage Vdata.

After the capacitor C is charged with the voltage corresponding to the first data voltage Vdata, at the beginning of the second period, the sixth and second transistors M6, M2 are turned on, and the switching device SW1 and the fifth and first transistors M5, M1 are turned off. As the sixth and second transistors M6, M2 are turned on, the pixel current Ipixel generated by the driver 142 is supplied to the comparator 241 via the second transistor M2, the data line Dj, and the sixth transistor M6.

The comparator 252 receives the pixel current Ipixel and the data current Idata, and compares the pixel current Ipixel with the data current Idata, thereby outputting the first or second control signal to the voltage adjuster 242 on the basis of the compared results. The data current Idata is an ideal current that should flow through the pixel 140 corresponding to the data Data, and the pixel current Ipixel is a real current through the pixel 140.

The data adjuster 242 receives the first control signal or the second control signal, and increments or decrements the stored data Data by the constant value CN, thereby generating the reset data Data. The adjusted data Data is supplied to the register 230*j*. The data adjuster 242 controls the digital value of the data Data to make the pixel current Ipixel approximately equal with the data current Idata. For example, in the case where the data adjuster 242 receives the first control signal, the data adjuster 242 decrements the digital value of the data Data by the constant value CN, thereby decreasing the pixel current Ipixel. On the other hand, in the case where the data adjuster 242 receives the second control signal, the data adjuster 242 increments the digital value of the data Data by the constant value CN, thereby increasing the pixel current Ipixel. The constant value CN is previously set with a predetermined value.

The adjusted data Data is supplied from the data adjuster 242 to the register 230*j*. Then, the register 230*j* supplies the adjusted data Data to the data voltage generator 250*j*. Then, the data voltage generator 250*j* generates the data voltage Vdata using the adjusted data Data.

Thereafter, the fifth transistor M5 and the first transistor M1 are turned on, and the sixth transistor M6 and the second transistor M2 are turned off. Then, the data voltage Vdata based on the reset data Data is supplied to the driver 142 via the buffer 270*j*, the fifth transistor M5, the data line Dj, and the first transistor M1. At this time, the driver 142 generates the pixel current Ipixel corresponding to the data voltage Vdata. According to an embodiment of the present invention, the sixth and second transistors M2, M6 are turned on and off at least once alternately with the fifth and first transistors M, M5, so that the data current Idata is similar to or equal to the pixel current Ipixel for the second period.

Referring to FIG. 6, the data current generator 260*j* may generate the data current Idata correspondence to the reset data Data. Actually, the data current Idata generated corresponding to the reset data is not an ideal current which should flow in the pixel 140. Therefore, when the data current Idata corresponding to the reset data Data is supplied to the comparator 241, an undesirable pixel current Ipixel flows through the pixel 140. To solve this problem, a switching part 255 can be additionally provided between the register 230 and IDAC 260 as shown in the FIG. 8.

Figure 8:
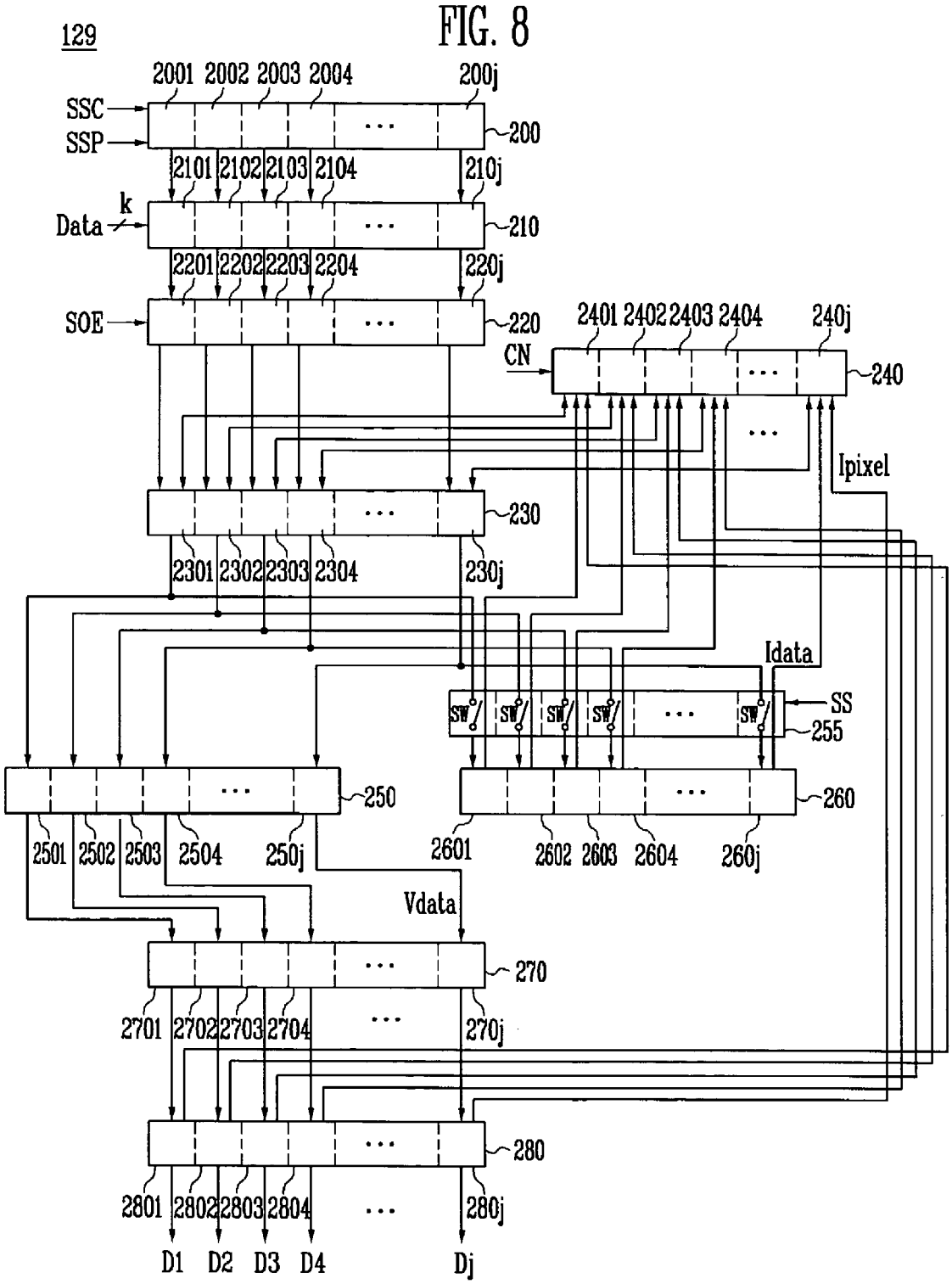
FIG. 8 is a schematic block diagram showing another embodiment of a data driver illustrated in FIG. 2.

FIG. 8 is a block diagram showing another embodiment of a data driver illustrated in FIG. 2. The switching part 255 includes switching devices SW provided in a number corresponding to the number of channels. For example, the switching part 255 includes j switch devices SW.

Figure 9:
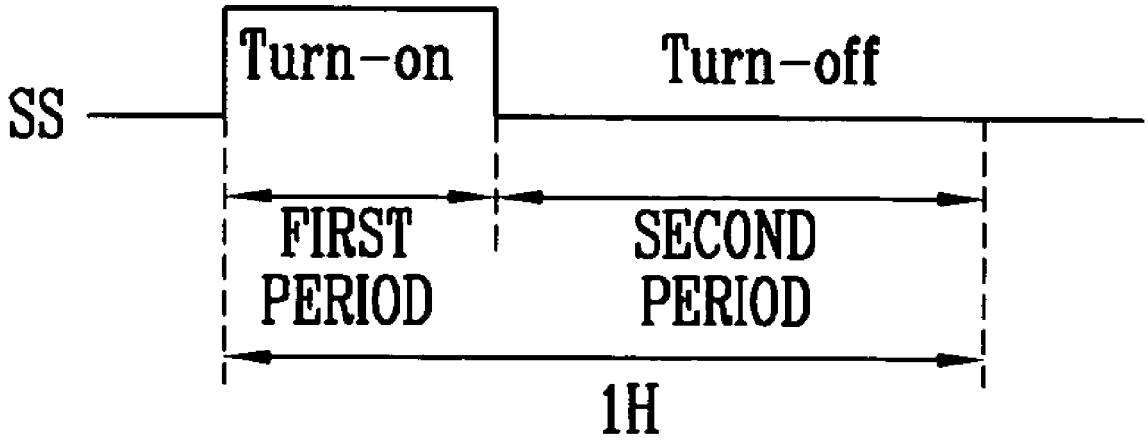
FIG. 9 shows a waveform of a signal for driving a switching part illustrated in FIG. 8.

FIG. 9 shows a waveform of a signal for driving the switching part 255 illustrated in FIG. 8. The switching device SW is turned on in response to an external selection signal SS for the first period of one horizontal period, and turned off for the rest of one horizontal period 1H, i.e., for the duration of the second period. Then, the reset data Data is not supplied to the register 230, and thus the desired data current Idata is supplied to the comparator 241.

Figure 10:
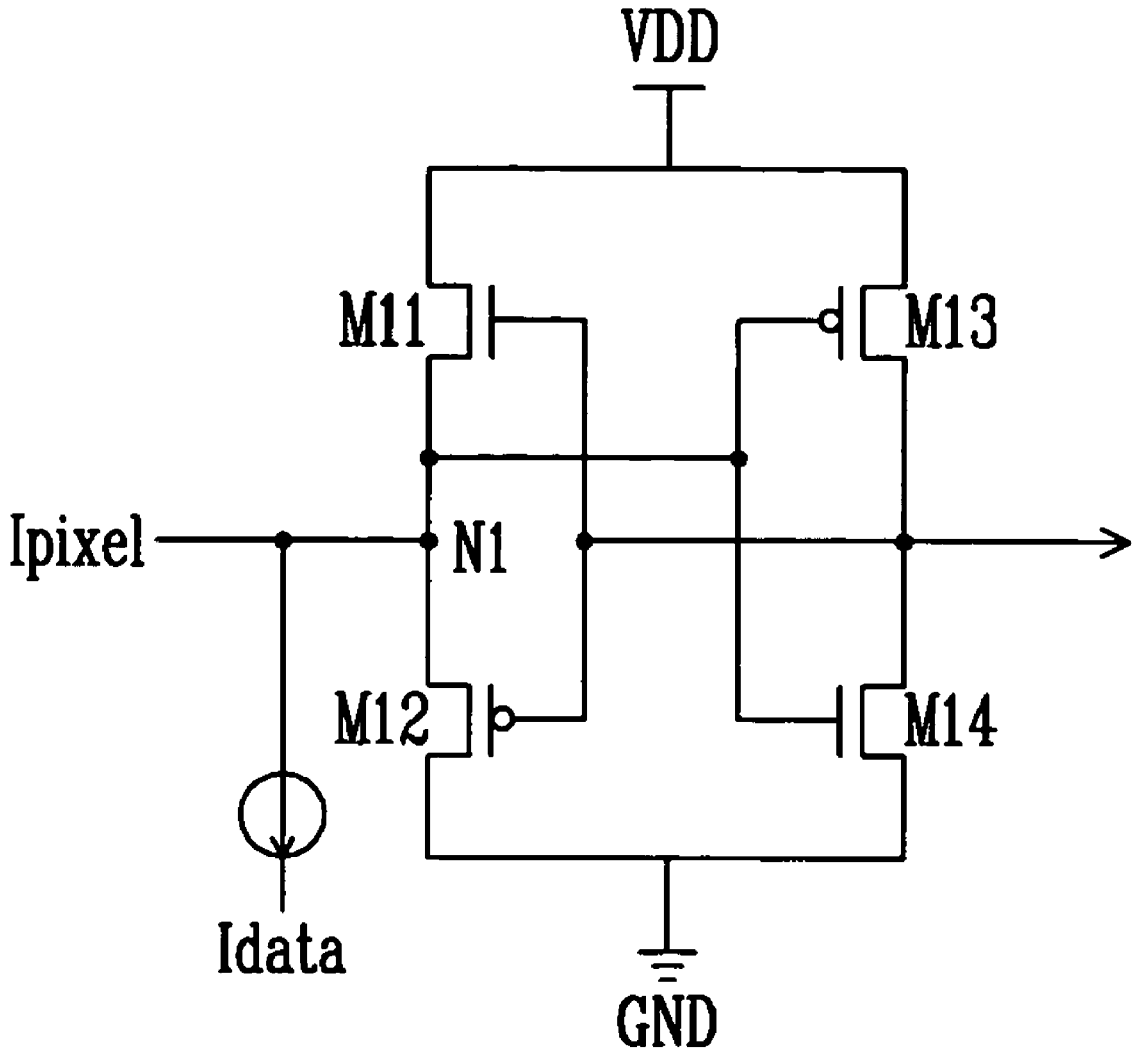
FIG. 10 is a circuit diagram of a comparator illustrated in FIG. 6.

FIG. 10 is a circuit diagram of a comparator 241 illustrated in FIG. 6. The comparator circuit illustrated in FIG. 10 was disclosed by the Institute of Electrical and Electronics Engineers (IEEE) in 1992. However, the comparator 241 according to embodiments of the present invention is not limited to the circuit proposed by IEEE. Alternatively, various well-known comparators may be used in the present invention as long as it can compare the currents.

In FIG. 10, the current corresponding to the difference between the pixel current Ipixel and the data current Idata is supplied to a first node N1. From the first node N1, the current is supplied to gate terminals of a third transistor M13 and a fourth transistor M14 coupled together to form as an inverter. This current turns on either the third transistor M13 or the fourth transistor M14, thereby applying a high voltage VDD or a low voltage GND to an output terminal. Here, the voltage applied to the output terminal is also supplied to the gate terminals of first and second transistors M11, M12, thereby maintaining the voltage at the output terminal stable.

Although a few embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display device comprising:

first and second scan lines;

a data line in a direction intersecting a direction of the first and second scan lines;

a display region including a pixel coupled to the first and second scan lines and to the data line;

a scan driver for supplying first and second scan signals to the first and second scan lines, respectively; and a data driving part coupled to the data line for converting external data into a data voltage and for supplying the data voltage to the data line, wherein the data driving part is configured to receive a pixel current, via the data line, from the pixel, and is configured to adjust a digital value of the data stored in a register in accordance with the received pixel current.

2. The organic light emitting display device according to claim 1, wherein the pixel comprises:

a light emitting device;

a driver for generating the pixel current that corresponds to the data voltage;

a first transistor coupled between the driver and the data line, and controlled by a first scan signal supplied through the first scan line; and a second transistor coupled between the data line and a common node formed between the driver and the light emitting device, and controlled by a second scan signal supplied through the second scan line.

3. The organic light emitting display device according to claim 2, wherein the first transistor is turned on in response to the first scan signal during a first period of a horizontal period, and turned on and off at least once during a second period of the horizontal period.

4. The organic light emitting display device according to claim 3, wherein the second transistor is turned off in response to the second scan signal during the first period, and turned on and off alternately with the first transistor during the second period.

5. The organic light emitting display device according to claim 2, further comprising a third transistor coupled between the driver and the light emitting device, wherein the third transistor is configured to be turned off by an emission control signal supplied during a period while the first scan signal is supplied to the first transistor, and wherein the third transistor is configured to be turned on for a remaining period.

6. The organic light emitting display device according to claim 1, wherein the data driving part comprises at least one data driver, each data driver including:

a register part to store the data;

a voltage digital to analog converter for generating a data voltage corresponding to the data stored in the register part;

a current digital-analog converter for generating a data current corresponding to the data stored in the register part;

a buffer part for supplying the data voltage to the pixels via a data line;

a data control unit for comparing the data current with a pixel current, corresponding to the data voltage, from the pixel, and controlling a digital value of the data on the basis of comparison; and a selection unit for selectively coupling the data line with either of the buffer part or the data control unit.

7. A data driver for an organic light emitting diode display including pixels, the data driver comprising:

a register part for storing external data;

a voltage digital to analog converter for generating a data voltage corresponding to the data stored in the register part;

a current digital to analog converter for generating a data current corresponding to the data stored in the register part;

a buffer part for supplying the data voltage to the pixels via a data line;

a data control unit, coupled to the register part and to the current digital to analog converter, for receiving a pixel current, corresponding to the data voltage, from the pixels via the data line and for adjusting a value of the data stored in the register part; and a selection unit, coupled to the buffer part and to the data control unit, for selectively coupling the data line with either of the buffer part or the data control unit.

8. The data driver according to claim 7, wherein the selection unit couples the data line with the buffer part during a first period of one horizontal period, and wherein the selection unit alternately couples the data line with either of the buffer part or the data control unit during a second period of the one horizontal period.

9. The data driver according to claim 8, wherein the selection unit comprises a selector including:

a first transistor coupled between the buffer part and the data line; and a second transistor coupled between the data line and the data control unit.

10. The data driver according to claim 9, wherein the first transistor is turned on during the first period, and wherein the first transistor and the second transistor are alternately turned on and off during the second period.

11. The data driver according to claim 10, wherein the data voltage is supplied to the pixel via the data line when the first transistor is turned on, and the pixel current is supplied from the pixel to the data control unit via the data line when the second transistor is turned on.

12. The data driver according to claim 7, wherein the data control unit is configured to compare the pixel current with the data current, and is configured to adjust the value of the data stored in the register part on the basis of the comparison.

13. The data driver according to claim 12, wherein the data control unit increments or decrements the value of the data by a preset value.

14. The data driver according to claim 12, wherein the data control unit comprises a data controller including:

a comparator for comparing the data current with the pixel current; and a data adjuster for increasing or decreasing the digital value of the data stored in the register part based on comparator results.

15. The data driver according to claim 8, further comprising a switching part, that is coupled between the current digital to analog converter and the register part, for electrically coupling the register part with the current digital to analog converter during the first period, and for electrically uncoupling the register part from the current digital to analog converter during the second period.

16. A method for controlling image brightness corresponding to data received in an organic light emitting display device having a pixel for emitting light, the method comprising:

converting the data into a data voltage and a data current;

supplying the data voltage to the pixel to generate a pixel current corresponding to the data voltage;

comparing the pixel current with the data current; and adjusting the data voltage to provide a desired image brightness by incrementing the data voltage if the pixel current is lower than the data current and decrementing the data voltage if the pixel current is higher than the data current.

17. The method of claim 16, further comprising:

supplying a first scan signal to the pixel to enable the data current to flow into the pixel; and supplying a second scan signal to the pixel to enable a pixel current generated in the pixel to flow out of the pixel, wherein the first scan signal and the second scan signal are supplied non-concurrently.

18. The method of claim 16, further comprising:

receiving a control signal for selecting either supplying the data voltage to the pixel or receiving the pixel current from the pixel.

19. The method of claim 18, further comprising:

driving the pixel during frames;

dividing each frame into a first period and a second period separate from the first period;

receiving the control signal for supplying the data voltage to the pixel during the entire first period; and alternately receiving the control signal for the supplying the data voltage to the pixel and the control signal for the receiving the pixel current from the pixel during the second period.

20. The method of claim 16, wherein the data is converted into the data current while supplying the data voltage to the pixel but not while receiving a pixel current from the pixel.

* * * * *